US008412121B2

(12) United States Patent
Bonnet et al.

(10) Patent No.: US 8,412,121 B2
(45) Date of Patent: Apr. 2, 2013

(54) CIRCUIT INTEGRATING A TUNABLE ANTENNA WITH A STANDING WAVE RATE CORRECTION

(75) Inventors: Benoît Bonnet, Tours (FR); François Dupont, Tours (FR)

(73) Assignee: STMicroelectronics (Tours) SAS, Tours (FR)

( * ) Notice: Subject to any disclaimer, the term of this patent is extended or adjusted under 35 U.S.C. 154(b) by 363 days.

(21) Appl. No.: 12/398,892

(22) Filed: Mar. 5, 2009

(65) Prior Publication Data

US 2010/0022203 A1 Jan. 28, 2010

(30) Foreign Application Priority Data

Mar. 7, 2008 (FR) ..... 08 51486

(51) Int. Cl.
*H01Q 1/36* (2006.01)

(52) U.S. Cl. ..... 455/77; 343/395; 343/700 MS

(58) Field of Classification Search ..... 455/248.1, 455/67.14, 115, 116, 77; 343/895, 700 MS
See application file for complete search history.

(56) References Cited

U.S. PATENT DOCUMENTS

| | | | | |
|---|---|---|---|---|
| 3,842,358 | A | 10/1974 | Frazier | |
| 6,029,051 | A | 2/2000 | Österberg et al. | |
| 6,933,893 | B2 * | 8/2005 | Rubinshteyn et al. | 343/700 MS |
| 6,952,565 | B1 | 10/2005 | Takeda et al. | |
| 7,071,776 | B2 * | 7/2006 | Forrester et al. | 330/129 |
| 7,164,387 | B2 * | 1/2007 | Sievenpiper | 343/702 |
| 7,711,337 | B2 * | 5/2010 | Mckinzie et al. | 455/248.1 |
| 2001/0040530 | A1 * | 11/2001 | Livingston et al. | 343/768 |
| 2002/0180650 | A1 | 12/2002 | Pankinaho et al. | |
| 2005/0057399 | A1 | 3/2005 | Kipnis et al. | |

OTHER PUBLICATIONS

French Search Report dated Nov. 4, 2008 from corresponding French Application 08/51486.

* cited by examiner

*Primary Examiner* — Dinh T. Le
(74) *Attorney, Agent, or Firm* — Wolf, Greenfield & Sacks, P.C.

(57) ABSTRACT

An integrated electronic radio-frequency transceiver circuit, including: at least one terminal intended to receive a signal to be transmitted or to transmit a received signal; at least one planar antenna, with a settable resonance frequency; at least one bidirectional coupler having a primary line interposed between the terminal and the antenna and having the respective terminals of a secondary line providing data representative of the transmitted power and of the power reflected on the primary line side; at least one detector of the transmitted power and of the reflected power; and a circuit for selecting the resonance frequency of the antenna according to the ratio between the transmitted power and the reflected power.

4 Claims, 3 Drawing Sheets

CIRCUIT INTEGRATING A TUNABLE ANTENNA WITH A STANDING WAVE RATE CORRECTION

CROSS REFERENCE TO RELATED APPLICATIONS

This application claims the priority benefit of French patent application number 08/51486, filed on Mar. 7, 2008, entitled "CIRCUIT INTEGRATING A TUNABLE ANTENNA WITH A STANDING WAVE RATE CORRECTION," which is hereby incorporated by reference to the maximum extent allowable by law.

BACKGROUND OF THE INVENTION

1. Field of the Invention

The present invention relates generally to electronic circuits and, more specifically, to radio-frequency transceiver circuits, intended for very high frequencies (greater than 100 MHz).

2. Discussion of the Related Art

A problem which is particularly critical for high frequencies is that the system environment has a direct influence upon the impedance of the antenna. As a result, even for an antenna having good nominal characteristics in terms of ratio of the transmitted power to the reflected power (RL—Return Loss), this ratio may be disturbed by the environment, for example, when a user's hand comes close to the antenna. Now, high frequency ranges are widely used in mobile applications (cell phone, wireless connection of a portable computer, etc.) so that the effect of the human body (or another disturbing element) on the impedance of the antenna is not negligible.

Such modifications of the antenna's impedance have led, up to now, to interposing impedance matching circuits.

FIG. 1 is a block diagram illustrating a usual impedance matching solution. A transmit circuit 1 (SEND) is connected, via an integrated circuit 2, to a transceiver antenna 3. Circuit 2 comprises an adjustable impedance matching circuit 21 (MATCH). The impedance adjustment is performed by means of a first coupler 22 of distributed type, interposed between transmit circuit 1 and impedance matching circuit 21, and a second coupler 23, interposed between impedance matching element 21 and antenna 3. Coupler 22 provides, on an output terminal ISO of its secondary line, data relative to the power reflected by the antenna. Coupler 23 provides data relative to the power transmitted to the antenna to a detector 25 (DETECT) to reduce the insertion losses of circuit 21. The two detectors 24 and 25 provide the measured data to a control circuit 26 (CTRL) which adjusts the parameters of impedance matching circuit 21 according to a reference value (for example, 50 ohms) to reduce the insertion losses of circuit 21 and to improve the impedance matching at the level of transmit circuit 1. In the shown example, the case of a twin-wire connection between circuits 26 and 21, transmitting voltage data enabling matching of circuit 21, is considered. The matching circuit most often is an inductive and capacitive circuit (LC) having its capacitive elements settable by circuit 26.

When the antenna is disturbed by an external element, the modification of its input impedance is detected in the form of a variation of the transmitted and/or reflected power, which enables circuit 26 to modify the impedance of circuit 21 to maintain a matching supposed to be optimal between circuit 1 and antenna 3.

However, matching circuits generally have narrow operation bands, that is, they must be selected according to the frequency range for which the transceiver circuit is intended.

Further, the presence of a matching circuit adds losses in the transmission chain by the capacitive and inductive elements in series between the output of transmit circuit 1 and antenna 3.

Moreover, the power capacity is altered for the components forming circuit 21 when the mismatch is significant.

SUMMARY OF THE INVENTION

It would be desirable to have a transceiver circuit which operates in a wide frequency range.

It would also be desirable to have a transceiver circuit with a decreased sensitivity to the outer environment.

It would also be desirable to have a transceiver circuit in which line losses are decreased.

To achieve all or part of these objects as well as others, at least one embodiment of the present invention provides an integrated electronic radio-frequency transceiver circuit, comprising:

at least one terminal intended to receive a signal to be transmitted or to transmit a received signal;

at least one planar antenna, with a settable resonance frequency;

at least one bidirectional coupler having a primary line interposed between said terminal and the antenna and having the respective terminals of a secondary line providing data representative of the transmitted power and of the power reflected on the primary line side;

at least one detector of the transmitted power and of the reflected power; and a circuit for selecting the resonance frequency of the antenna according to the ratio between the transmitted power and the reflected power.

An embodiment provides such a circuit having no impedance matching circuit.

According to an embodiment, the antenna with a settable frequency comprises one or several miniature electromechanical switches interposed between conductive elements.

According to an embodiment, the antenna with a variable frequency comprises one or several elements of settable capacitance.

According to an embodiment, a radio-frequency transceiver circuit is provided.

An embodiment provides such a device having no impedance matching circuit.

The foregoing objects, features, and advantages of the present invention will be discussed in detail in the following non-limiting description of specific embodiments in connection with the accompanying drawings.

DETAILED DESCRIPTION

Figure 1:
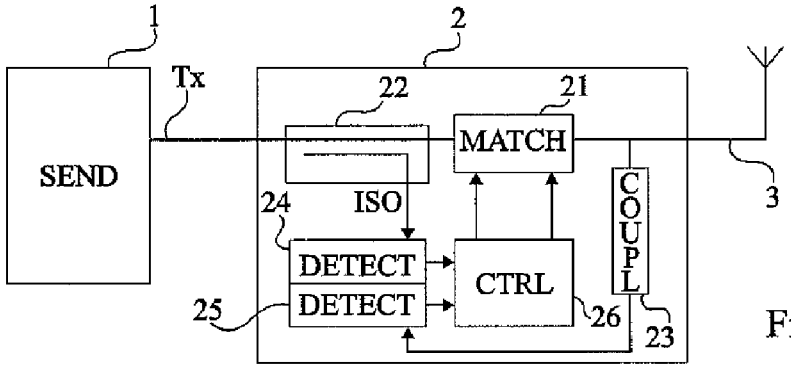
FIG. 1, previously described, is intended to illustrate the state of the art and the problem to solve.

The same elements have been designated with the same reference numerals in the different drawings.

For clarity, only those elements which are useful to the understanding of the present invention have been shown and will be described. In particular, the circuits for generating the signals to be transmitted and processing the received signals have not been detailed, the present invention being compatible with usual circuits.

Figure 2:
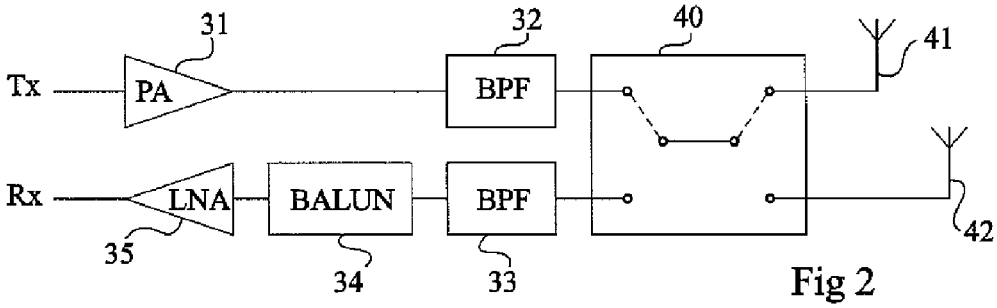
FIG. 2 is a block diagram of an example of a radio-frequency transceiver chain.

FIG. 2 is a block diagram of an example of a radio-frequency transceiver chain of the type to which the present invention applies.

On the transmit side, a signal Tx to be transmitted proceeds through an amplifier 31 (PA) before being processed by a band-pass filter 32 (BPF) for transmission by an antenna 41 or 42. A so-called diversified switch 40 is in charge of routing the signal to be transmitted from filter 32 to antenna 41 or 42. On the receive side, switch 40 routes a received signal from antenna 41 or 42 to a band-pass filter 33. Filter 33 is, in receive mode, followed by a balun transformer 34 (BALUN) and of a low-noise amplifier 35 (LNA) providing a signal Rx to processing circuits. The diagram of FIG. 2 for example corresponds to a Bluetooth-type transceiver architecture.

Figure 3:
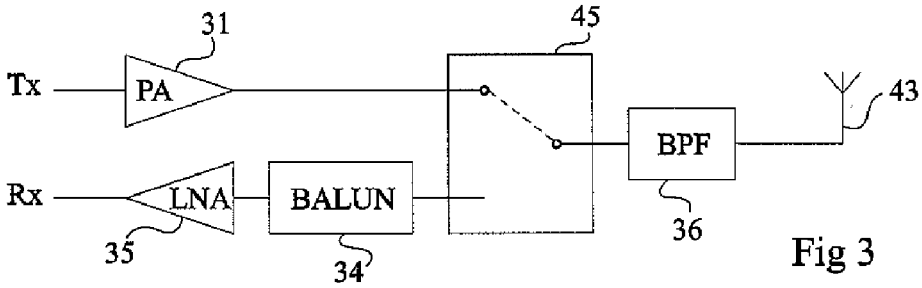
FIG. 3 is a block diagram of another radio-frequency transceiver chain example.

FIG. 3 illustrates another example of application of a radio-frequency transceiver chain. In this case, signal Tx to be transmitted crosses a transmit amplifier 31, then a switch 45 (Rx/Tx) in charge of routing the received signal with respect to the transmitted signal. Switch 45 is followed by a band-pass filter 36, common to the transmission and to the reception, connected to a common antenna 43. In receive mode, a signal originating from antenna 43 and having passed through filter 36 passes through switch 45, then a mode-switching transformer 34 and an amplifier 35, to provide signal Rx. The embodiment of FIG. 3, for example, corresponds to a transceiver circuit of ultra wide band type (UWB).

Figure 4:
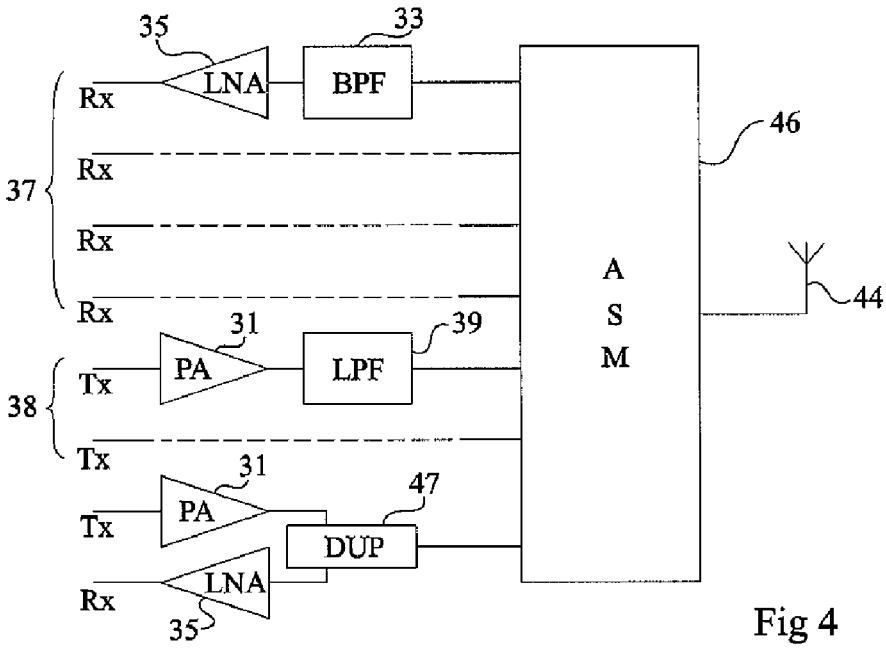
FIG. 4 is a block diagram of still another radio-frequency transceiver chain example.

FIG. 4 illustrates another example of application in which an antenna 44 is shared by several transceiver circuits by means of an antenna switch 46. For example, paths of a first group 37, each comprising a band-pass filter 33 and a low-noise amplifier 35, are intended for the reception of mobile telephony signals in different frequency bands. Paths of a second group 38, each comprising a low-pass filter 39 and a transmit amplifier 31, are intended for the transmission of mobile telephony signals in different frequency bands. A third path comprises a duplexer 47 (typically of band-pass filter type) between an amplifier 31 of transmission and an amplifier 35 of reception of signals to be transmitted and of received signals. This path, for example, corresponds to data transmissions.

In all the above applications, a disturbance in the environment of the antenna risks generating significant losses in the transmission or the reception under the effect of a mismatch.

Figure 5:
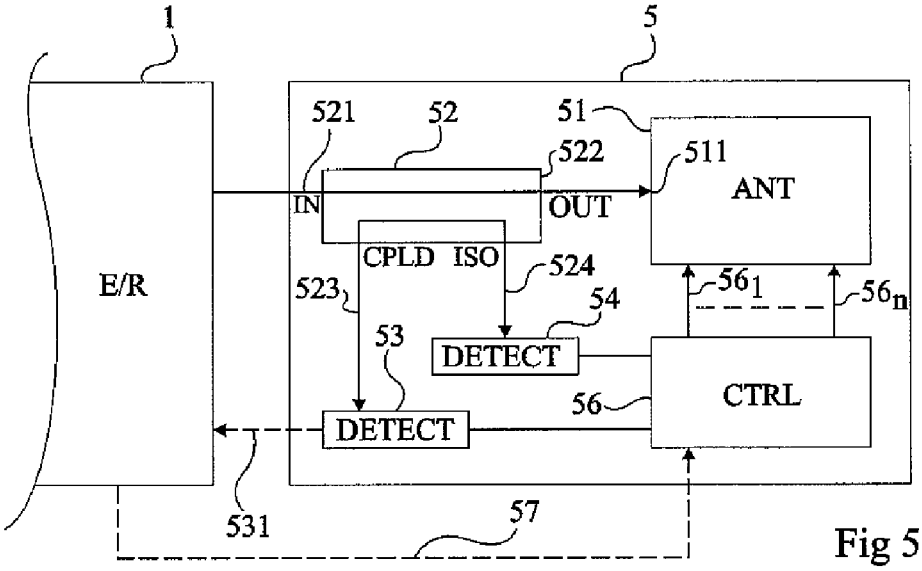
FIG. 5 is a block diagram of an antenna circuit according to an embodiment of the present invention.

FIG. 5 is a block diagram of an antenna circuit 5 according to an embodiment. This circuit integrates a planar antenna 51 having its access 511 connected to a first end 522 of a main line of a coupler 52 with distributed lines, the other end 521 of this main line of the coupler being intended to be connected to radio-frequency transceiver circuits 1 (E/R). The two ends 523 and 524 of a secondary (or coupled) line of coupler 52 are respectively connected to detection circuits 53 and 54 (DETECT) having respective outputs connected to an integrated circuit 56 (CTRL) for controlling an adjustment of the tuning frequency of antenna 51. Antenna circuit 5 is for example intended to form antenna 41, 42, 43, or 44 of the circuits of FIGS. 2 to 4, head 1 being then supposed to contain the different filters, baluns, antenna switches, etc.

Coupler 52 is a bidirectional coupler and is thus capable, for example in transmit mode, of providing on access 523 (CPLD) data relative to the transmitted power $P_F$ between accesses 521 (IN) and 522 (OUT) of the coupler and, on the other access 524 (ISO) of the coupled line, data relative to the power $P_R$ reflected by the antenna. The exploitation of both data, measured by circuits 53 and 54 and provided to circuit 56, enables determining the ratio between the reflected and transmitted powers, and accordingly modifying the resonance frequency of antenna 51.

Coupler 52 may also be used, via detector 53, to provide data (connection 531) to circuit 1 to adjust the transmit power of the amplifier comprised in the circuit, by providing it with data relative to the transmitted power.

Coupler 52 preferably is a wide-band bidirectional coupler able to operate over the entire frequency band for which circuit 5 is intended. It further exhibits a good directivity, to make out the transmitted power from the reflected power. For a bidirectional coupler, it is considered that a good directivity corresponds to a power difference between ports CPLD and ISO of at least 25 dB while all ports are loaded with 50-ohm impedances.

As compared with the insertion of impedance matching circuits, circuits 5 decreases insertion losses since there now only is one coupler between circuit 1 and antenna 51. Low insertion losses correspond to losses smaller than 1 dB and, preferably, smaller than 0.5 dB.

The frequency adjustment of antenna 51 by means of circuit 56 is performed under control of signals $\mathbf{56}_1$ to $\mathbf{56}_n$ ($n \geqq 1$) provided by circuit 56. Number n of signals and their type depends on the provided type of adjustable antenna.

Figure 6:
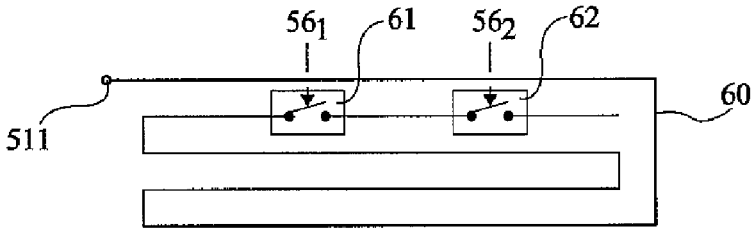
FIG. 6 schematically shows an embodiment of an adjustable antenna.

FIG. 6 shows a first example of a planar antenna with an adjustable resonance frequency. It is a wire antenna formed of a conductive serpentine 60, deposited on an insulating substrate (not shown). Serpentine 60 may be interrupted, for example, in two places (switches 61 and 62). The opening of one of the switches causes a shortening of the antenna length, and thus a change in its tuning frequency from its access 511. For example, the switches are of micro-electromechanical type (MEMS) and receive, for example, D.C. control signals $\mathbf{56}_1$ to $\mathbf{56}_2$ from circuit 56.

Figure 7:
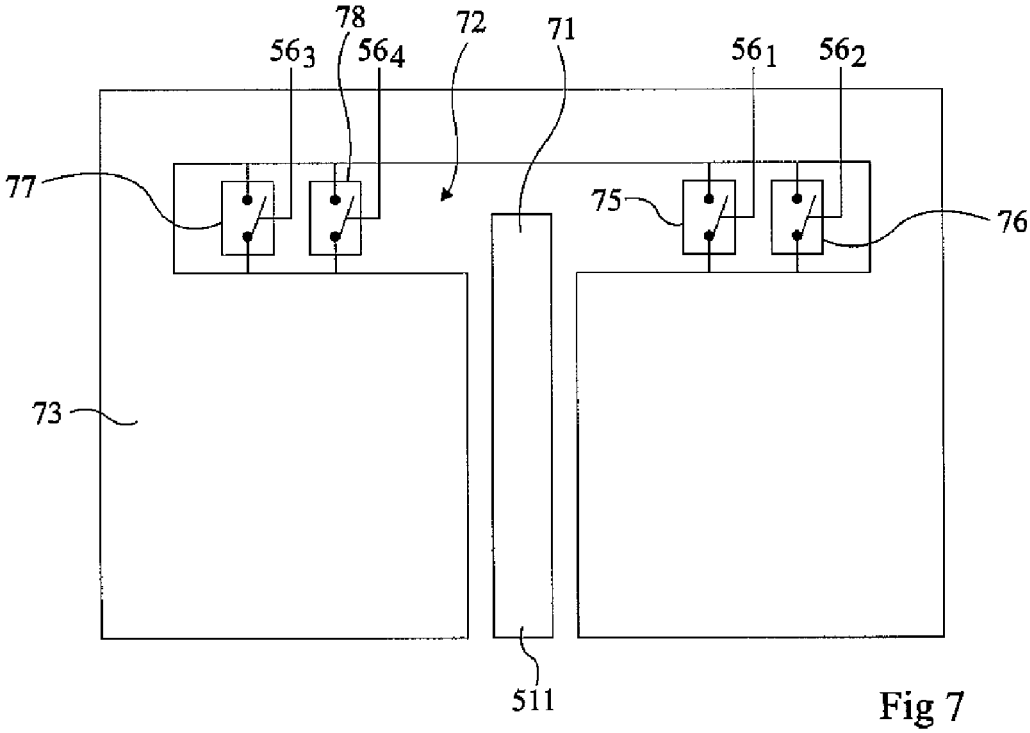
FIG. 7 shows another embodiment of an adjustable antenna.

FIG. 7 schematically shows a second example of a planar antenna formed of a so-called slot antenna. A planar conductive section 71 is formed in a slot or window 72 made in a ground plane 73 on an insulating substrate (not shown). The slot has an approximate T shape and section 71 extends in the entire vertical branch of the T. In this example, two switches 75 and 76, respectively 77 and 78, are provided on either side of the vertical branch of the T to connect the two edges of conductive plane 73 to two locations on the horizontal portions of the T. Here again, a closing of one of switches 75 to 78 modifies the resonance frequency of the antenna. The switches, for example miniature electromechanical switches, are individually controlled by signals $\mathbf{56}_1$ to $\mathbf{56}_4$.

Figure 8:
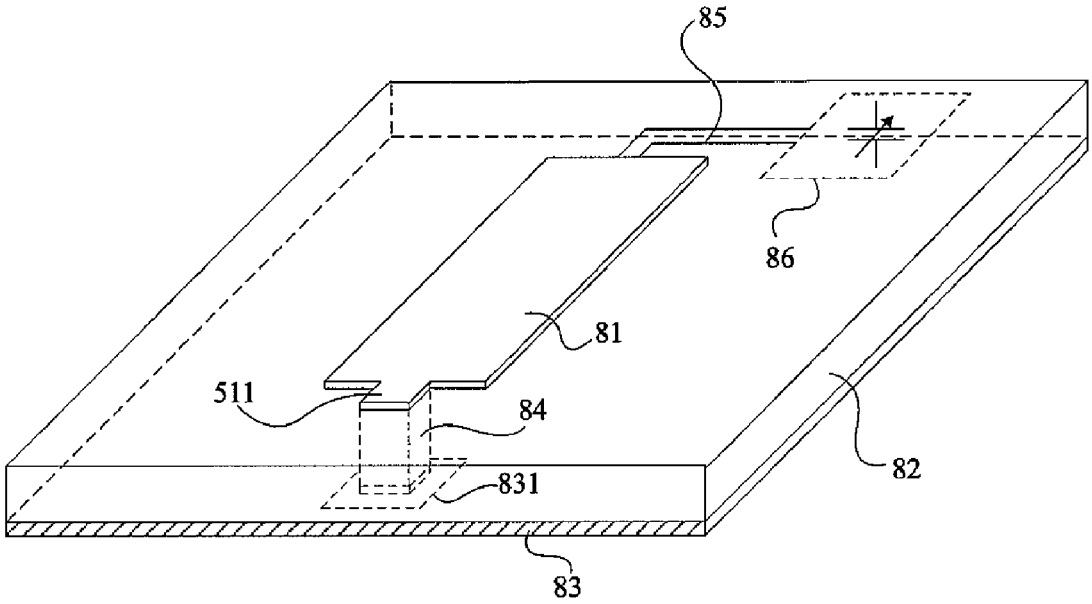
FIG. 8 shows still another embodiment of an adjustable antenna.

FIG. 8 is a simplified perspective view of a third embodiment of a PIFA-type adjustable antenna. A planar conductive section 81 is formed on an insulating layer 82 above a ground plane 83. One end of strip 81, intended to form access 511 of the antenna, is for example brought under ground plane 83 by a conductive via 84 crossing a window 834 of the ground plane. A connection 85 to a capacitive element of variable capacitance 86 (schematically illustrated in dotted lines) is provided at the other end of section 81. Variable-capacitance element 86 may be a Varicap diode, a switched capacitor network, a PIN diode, etc.

The discussed embodiments enable avoiding the use of an impedance matching network.

Further, a same antenna may be used for several frequencies and for several transmission types (for example, for several mobile telephony transmission-reception bands).

For a matching of the antenna according to reference values provided by the transceiver head (for example for a frequency band switching), control circuit 56 receives one or several reference signals (connection 57 in dotted lines, FIG. 5) enabling it to adjust the exploited reference value according to the results provided by detectors 53 and 54. Thus, it is possible not only to control the antenna frequency to maintain a ratio between the transmitted power and the reflected power for a given frequency band, but also to modify the tuning frequency according to the application.

An adaptable voltage standing wave ratio (VSWR) correction antenna has thus been obtained.

Various embodiments have been described. Different alterations, modifications and improvements are within the abilities of those skilled in the art, especially as to the selection of the type of adjustable antenna according, for example, to the control circuit available or that can easily be formed in the circuit. Further, the practical implementation of the present invention is within the abilities of those skilled in the art based on the functional indications given hereabove.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A radio frequency transceiver circuit comprising:

a planar antenna having a resonant frequency that is adjustable, wherein the planar antenna includes a conductive ground plane having a T-shaped slot in the conductive ground plane, and switching elements connected between opposite edges of the ground plane on a horizontal section of the T-shaped slot in the conductive ground plane, the switching elements being configured to adjust the resonance frequency of the antenna;

a bidirectional coupler configured to couple power to and from the antenna, the bidirectional coupler including a primary line and a secondary line, the secondary line providing a first signal representative of transmitted power and a second signal representative of reflected power on the primary line;

a first detection circuit configured to detect the first signal representative of transmitted power;

a second detection circuit configured to detect the second signal representative of reflected power; and a control circuit configured to adjust the resonance frequency of the antenna, based on a ratio of the detected transmitted power to the detected reflected power, by controlling the switching elements of the planar antenna.

2. A radio frequency transceiver circuit as defined in claim 1 wherein the resonance frequency of the antenna is adjustable in response to one or more control signals supplied by the control circuit.

3. A radio frequency transceiver circuit as defined in claim 1, wherein the antenna includes at least one variable capacitor configured to adjust the resonance frequency of the antenna.

4. A radio frequency transceiver circuit as defined in claim 1, wherein a primary line of the bidirectional coupler is connected directly to the antenna.

* * * * *